United States Patent [19]

Maguire

[11] Patent Number: 4,523,060

[45] Date of Patent: Jun. 11, 1985

[54] COMBINATION KEYBOARD

[75] Inventor: Helen E. Maguire, Post Falls, Id.

[73] Assignee: Advanced Input Devices, Inc., Couer d'Alene, Id.

[21] Appl. No.: 552,705

[22] Filed: Nov. 17, 1983

[51] Int. Cl.[3] ..... H01H 9/26

[52] U.S. Cl. ..... 200/5 A; 200/159 B; 200/292; 340/365 R

[58] Field of Search ..... 200/5 A, 159 B, 292, 200/5 R, 159 R; 340/365 R, 365 A

[56] References Cited

U.S. PATENT DOCUMENTS

| | | | |
|---|---|---|---|
| 3,908,100 | 9/1975 | Richard et al. | 200/5 |
| 4,139,756 | 2/1979 | Tsen et al. | 200/330 |
| 4,180,711 | 12/1979 | Hirata et al. | 200/5 A |
| 4,246,452 | 1/1981 | Chandler | 200/5 A |
| 4,293,764 | 10/1981 | Amrhein | 200/302 |
| 4,322,588 | 3/1982 | Chumley et al. | 200/5 A |
| 4,362,954 | 12/1982 | Cotton | 307/142 |
| 4,364,619 | 12/1982 | Inayat-Khan | 200/5 A X |

*Primary Examiner*—Reinhard J. Eisenzopf

*Assistant Examiner*—Susan Steward

*Attorney, Agent, or Firm*—Christensen, O'Connor, Johnson & Kindness

[57] ABSTRACT

A combination keyboard including a first set of switches closed by depressing discrete keys (b 21) and a second set of switches closed by depressing selected areas (69) of a flexible overlay (49) is disclosed. The first set of switches includes a printed wire board (pwb) (23) having switch terminals (31) on one surface. Overlying the switch terminals are switch closing elements, which may take the form of caged metal domes (29). Overlying the closing elements are the discrete keys (21). The second set of switches also includes a pwb (41) having switch terminals (51) on one surface and overlying switch closing elements, which may also take the form of caged metal domes (59). The flexible overlay (49) is positioned atop the switch closing elements. Further, the pwb and flexible overlay include aligned apertures (57, 71) through which the discrete keys (21) pass. Thus, both the discrete keys (21) and the flexible overlay (49) lie in substantially the same actuation plane.

8 Claims, 4 Drawing Figures

COMBINATION KEYBOARD

TECHNICAL AREA

This invention relates to keyboards and, more particularly, keyboards that include switches actuated by the depression of a key.

BACKGROUND OF THE INVENTION

Keyboards form an interface between an operator of equipment (such as chemical processing equipment, numerically controlled machine tools, computers etc.) and the equipment, which allow the operator to manually enter commands and/or data. Commands cause the equipment to operate in a particular manner. Data is mathematically manipulated by the equipment. The result of the manipulation may be used to control a display or used to create signals for controlling associated equipment such as chemical processing equipment, machine tools, laboratory test equipment, etc.

In the past, most keyboards included discrete keys overlying switch elements such that an associated switch element is closed each time a key is depressed. The main disadvantage of such "discrete" keyboards is the high production cost associated with their inclusion of mechanical mechanisms that support discrete key elements in a manner that allows the keys to be rapidly actuated.

More recently, keyboards formed of an overlay positioned atop the switch elements have been developed. When a "key" area of the overlay is depressed, the underlying switch element is actuated. Such keyboards are commonly referred to as "membrane" keyboards. The major advantage of membrane keyboards over discrete keyboards is their substantially lower production cost. On the other hand, even advanced versions of membrane keyboards, which include a dome that generates an audible "click" and produces a slight tactile sensation when a key is actuated, have disadvantages. Specifically, membrane keyboards have the disadvantage that they are difficult to use rapidly. That is, experience has shown that discrete keyboards can be manually operated more rapidly than membrane keyboards. As a result, discrete keyboards are more desirable for use in high speed data entry environments than membrane keyboards and membrane keyboards are more desirable in slower speed data and command entry environments where keyboard cost is a significant concern. The present invention is directed to providing a combination keyboard that takes advantage of the desirable attributes of both types of keyboards.

SUMMARY OF THE INVENTION

In accordance with this invention, a combination keyboard is provided. The combination keyboard includes a first set of switches closed by depressing discrete keys and a second set of switches closed by depressing selected areas of a flexible overlay. Both the discrete keys and the flexible overlay lie substantially in the same plane. Thus, the invention combines a discrete keyboard with a membrane keyboard to provide a combination keyboard that is readily accessable by an operator.

In accordance with further aspects of this invention, the first set of switches, i.e., the switches actuated by depressing discrete keys, includes a printed wire board (pwb) having switch terminals on one surface. Overlying the switch terminals are switch closing elements.

The closing elements are overlaid by the discrete keys. While the preferred form of the switch closing elements are metal domes, the switch closing elements can take on other forms such as a plastic bubble membrane or a conductive elastomer, for examples. Regardless of form, when moved by depressing a discrete key, the associated switch is closed, i.e., switch closing elements creates a conductive path between a pair of switch terminals located on the common surface of the pwb.

In accordance with further aspects of this invention, the second set of switches, i.e., the switches actuated by the membrane keyboard, also includes a pwb having switch terminals on one surface and overlying switch closing elements. The flexible overlay is positioned atop the switch closing elements. As with switch closing elements actuated by discrete keys, while the preferred form of the membrane key actuated switch closing elements are metal domes, other forms of switch closing elements can be used; such as plastic bubble membrane "domes" and conductive elastomer "domes."

In accordance with still further aspects of this invention, the pwb and flexible overlay of the membrane keyboard include aligned holes through which the discrete keys of the discrete keyboard pass. As a result, the discrete keys and the flexible overlay lie in substantially the same actuation plane.

As will be readily appreciated from the foregoing description, the invention provides a keyboard that combines the high input speed advantages of a discrete keyboard with the low-cost advantages of a membrane keyboard. More specifically, utilizing membrane keys to enter relatively infrequent commands and discrete keys to enter data and/or relatively frequent commands, results in a minimum cost keyboard having the ability to receive both high speed operator inputs and low speed operator inputs.

BRIEF DESCRIPTION OF THE DRAWINGS

The foregoing objects and many of the attendant advantages of this invention will become more readily appreciated as the same becomes better understood by reference to the following detailed description when taken in conjunction with the accompanied drawings wherein.

DESCRIPTION OF THE PREFERRED EMBODIMENT

Figure 1:
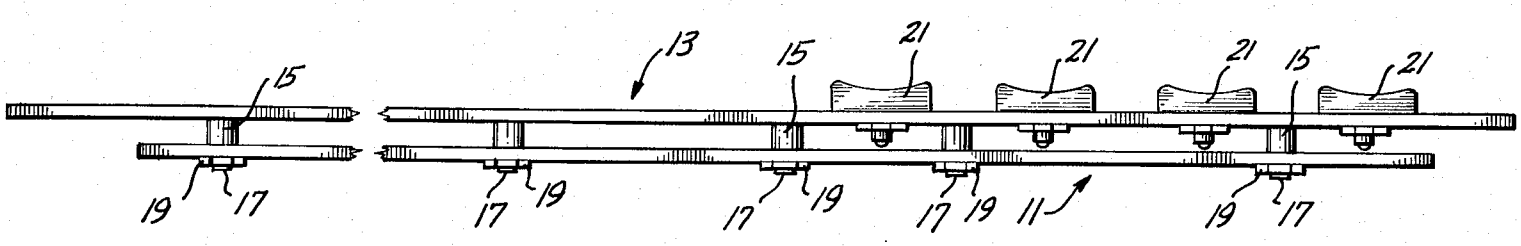
FIG. 1 is a side elevational view of a combination keyboard formed in accordance with the invention.

FIG. 1 illustrates a combination keyboard formed in accordance with the invention. The combination keyboard illustrated in FIG. 1 comprises: a discrete keyboard 11; and, a membrane keyboard 13. The two keyboards lie in spaced-apart parallel planes with the membrane keyboard 13 overlying the discrete keyboard 11. Studs 17 extend toward the discrete keyboard 11 from the membrane keyboard 13. Mounted on the studs 17, between the discrete keyboard 11 and the membrane keyboard 13, are spacers 15. Nuts 19 are threaded onto the exposed ends of the studs 17. As a result, the discrete keyboard 11 and the membrane keyboard 13 are rigidly held in fixed, spaced-apart positions. The keys 21 whose depression actuates the discrete keyboard 11 pass through apertures in the membrane keyboard 13.

Figure 3:
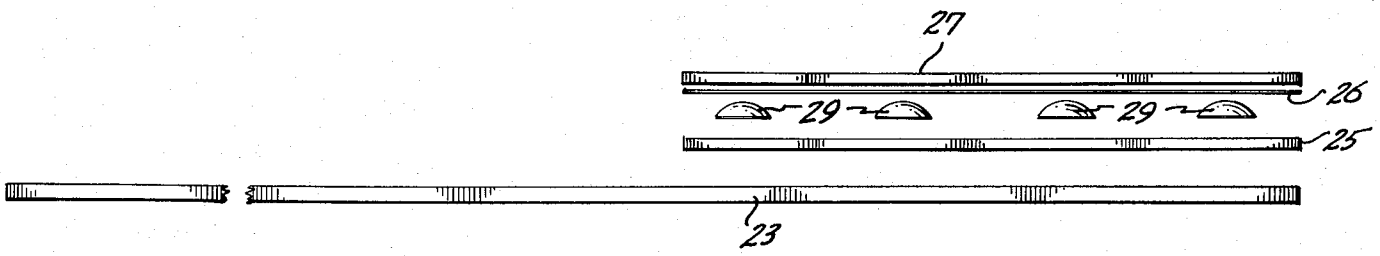
FIG. 3 is a side elevational exploded view of the discrete keyboard portion of the combination keyboard illustrated in FIGS. 1 and 2A and 2B.

Both the discrete keyboard 11 and the membrane keyboard 13 are formed of sandwiches of discrete layers. As illustrated in FIGS. 2B and 3, the discrete key keyboard 11 comprises: a printed wire board (pwb) 23; a dome cage 25; a thin retaining film 26; an actuating film 27; and, a plurality of domes 29. Located on one face of the pwb 23 are a plurality of switch contact areas 31. In the embodiment of the invention illustrated in the drawings, the switch contact areas 31 are located on the right side of the pwb 23, near the lower edge thereof. Obviously, depending upon the configuration of the invention, the switch contact areas 31 could be located in any of a wide variety of positions on the pwb 23. In any event, each of the switch contact areas 31 includes a pair of switch terminals—preferably a dot terminal partially surrounded by a circular terminal.

The dome cage 25 is an insulating layer that includes a plurality of dome cage holes 33 positioned so as to be alignable with the switch contact areas 31 when the dome cage 25 is mounted atop the pwb 23. Mounted in each of the dome cage holes 33 is a dome 29. The domes 29 may be formed of partially spherical pieces of metal having edge areas removed so as to produce a plurality of "legs." Since such switch closing elements are well known to those skilled in the low profile keyboard switch art, they are not described here. Alternatively, the domes may take the form of plastic bubble memory domes or conductive elastomer domes, both of which are also known to those skilled in the low profile keyboard art and, thus, are not described here.

The thin retaining film 26 is mounted over the dome cage 25 and the domes 29. The actuating film 27 is mounted atop the thin retaining film 26. Preferably, the actuating film 27 includes downwardly projecting dimples positioned above each of the domes 29. Mounted atop the film 27 are key mounting assemblies 35, which may comprise a plurality of standoffs 37 and rods 39. The rods 39 are mounted in the standoffs 37 and the discrete keys 21 are mounted on the rods 39, as is also well known to those skilled in the low profile keyboard switch art. The keys 21, of course, are positioned so as to overlie the film 27, above the dimples that impinge on the domes 29. As a result, when a discrete key 21 is depressed, a force is applied to the film 27 that causes the associated dimple to depress the associated dome 29.

Figure 2A:
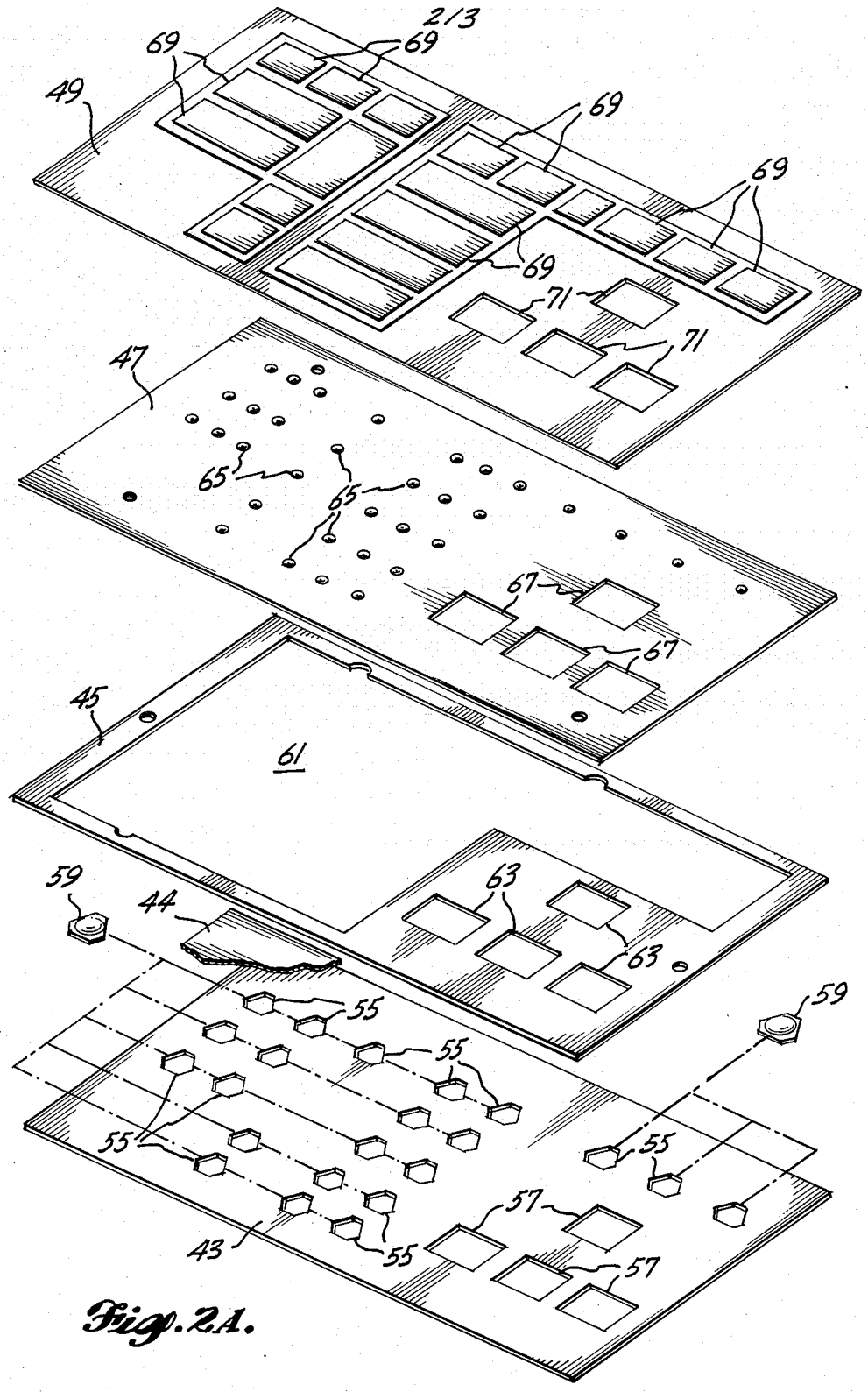
FIGS. 2A and 2B combine to form an exploded view of the major elements of the combination keyboard illustrated in FIG. 1.
Figure 2B:
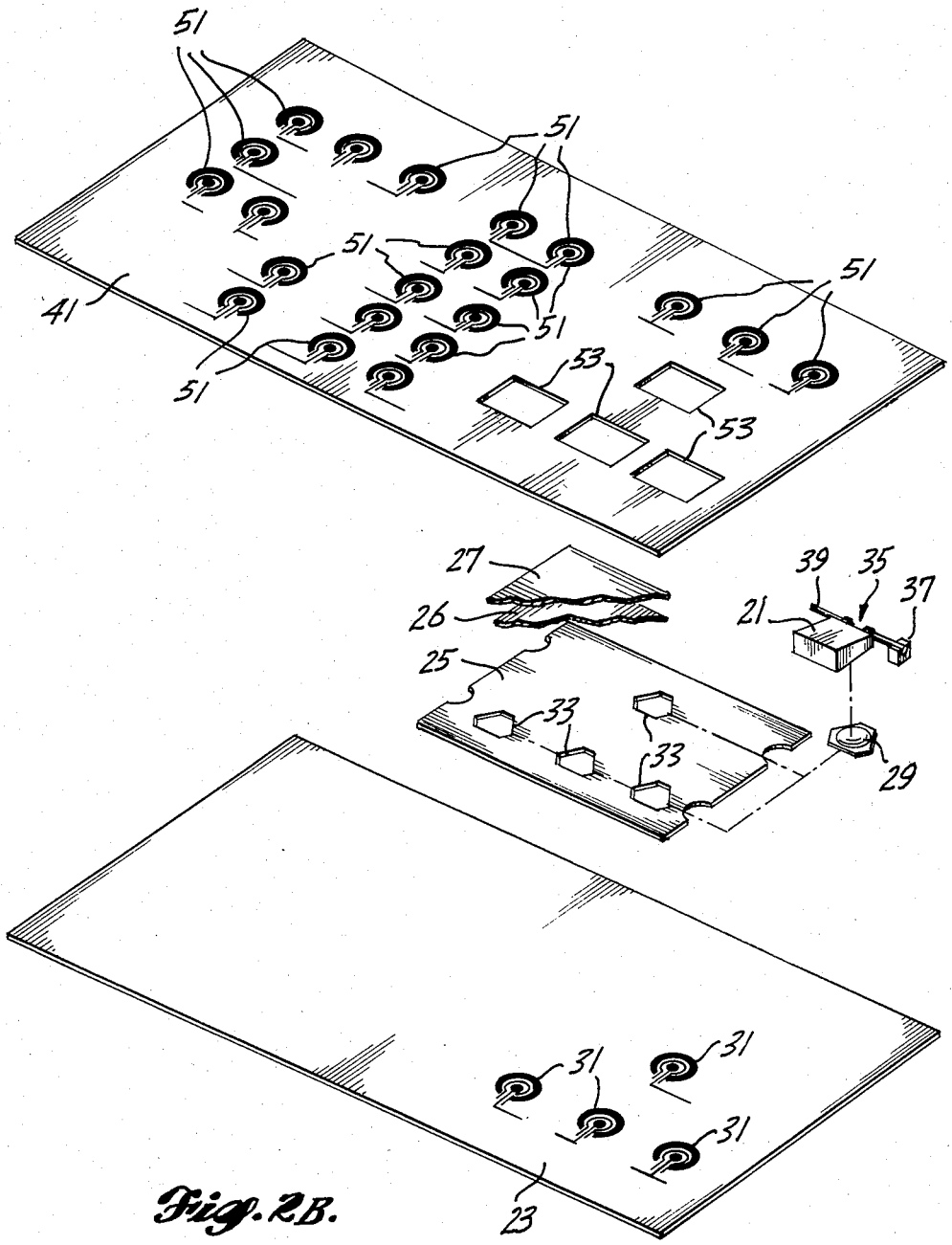

As illustrated in FIGS. 2A and 2B, the membrane keyboard 13 comprises: a pwb 41; a dome cage 43; a thin retaining film 44; an actuator spacer 45; an actuator film 47; and, an embosses overlay 49. The pwb 41 includes a plurality of switch contact areas 51. Preferably, each of the switch contact areas 51 includes a dot terminal surrounded by a circular terminal. The pwb 41 also includes a plurality of key holes 53 positioned so as to be alignable with the discrete keys 21 when the combination keyboard is assembled in the manner illustrated in FIG. 1 and previously described. The dome cage 43 is an insulating layer that includes a plurality of dome cage holes 55 positioned so as to be alignable with the switch contact areas 51 formed in the pwb 41 when the dome cage 43 is mounted atop the pwb 41. The dome cage 43 also includes a plurality of key holes 57 positioned so as to be alignable with the key holes 53 in the pwb 41. Switch closing elements, i.e., domes 59 are mounted in the dome cage holes 55. The thin retaining film 44 is mounted over the dome cage 43 and the domes 29.

The actuator spacer 45 is an insulating layer mounted atop the retaining film 44. The actuator spacer includes a large aperture 61 that, in essence, "frames" the dome cage holes 55 formed in the dome cage 43. The actuator spacer 45 also includes a plurality of key holes 63 positioned so as to be alignable with the key holes 57 in the dome cage 43 and, thus, alignable with the key holes 53 in the pwb 41.

The actuator film 47 is mounted atop the actuator spacer 45 and includes a plurality of dimples 65 positioned so as to be alignable with the domes 59 mounted in the dome cage holes 55 formed in the dome cage 43. One dimple overlies each dome. The actuator film 47 also includes a plurality of key holes 67 alignable with the key holes 53, 57 and 63 formed in the pwb 41, the dome cage 43 and the actuator spacer 45.

The embossing overlay 49 is mounted atop the actuator film 47 and includes embossed indicia positioned above the dimples 65. As a result, when a particular embossed area is pressed, an associated dimple or dimples moves toward the pwb 41. The depressed dimple actuates a related switch by collapsing the associated dome 59. The embossed overlay 49 also includes a plurality of key holes 71 positioned so as to be alignable with the key holes 53, 57, 63 and 67 formed in the pwb 41, the dome cage 43, the actuator spacer 45, and the actuator film 47.

As will be readily appreciated from the foregoing description, the invention provides a keyboard that combines the high speed actuation advantage of a discrete keyboard and the low cost advantages of a membrane keyboard. More specifically, the combination keyboard of the present invention provides discrete keys usable to input data or commands at a rapid rate and low-cost membrane keys usable to enter infrequent data and/or commands. Thus, the invention provides a minimal cost keyboard that takes advantage of the primary benefits of both discrete and membrane keyboards.

While the preferred embodiment of the invention has been illustrated and described, it will be appreciated that various changes can be made therein without departing from the spirit and scope of the invention. For example, while only four discrete keys have been illustrated in the drawings, obviously, a larger or smaller number can be utilized, if desired. Similarly, the number of membrane "keys" can be greater or lesser than the number illustrated in the drawing. Consequently, the invention can be practiced otherwise than as specifically described herein.

The embodiments of the invention in which an exclusive property or privilege is claimed are defined as follows:

1. A combination keyboard comprising:

(a) a discrete keyboard comprising:

(1) a first set of depression actuated switches lying in a common plane, said first set of depression actuated switches comprising:

(i) a first printed wire board having a plurality of switch contact areas formed on one layer; and, (ii) a first plurality of depressable switch closing elements, one depressable switch closing element mounted atop each switch contact area, each of said switch contact areas and its overlying depressable switch closing element forming one of said first set of depression actuated switches;

(2) a plurality of discrete keys; and, (3) mounting means for mounting said plurality of discrete keys such that the keys overlie associated ones of said first set of depression actuated switches and such that the depression of a discrete key actuates its underlying associated switch by depressing the depressable switch closing element of said associated switch;

(b) a membrane keyboard comprising:

(1) a second set of depression actuated switches lying in a common plane, said second set of depression actuated switches comprising:

(i) a second printed wire board having a plurality of switch contact areas formed on one layer; and, (ii) a second plurality of depressable switch closing elements, one depressable switch closing element mounted atop each switch contact area, each of said switch contact areas and its overlying depressable switch closing element forming one of said second set of depression actuated switches; and, (2) a flexible membrane overlying said second set of depression actuated switches such that the depression of selected areas of said flexible overlay depresses and, thus, actuates an underlying associated switch, said membrane keyboard including a plurality of holes sized and positioned so as to allow said plurality of discrete keys of said discrete keyboard to partially extend through said membrane keyboard when said membrane keyboard overlies said discrete keyboard; and, (c) mounting means for mounting said membrane keyboard above said discrete keyboard such that the said discrete keys pass through said holes in said membrane keyboard such that said selected areas of said flexible overlay and said discrete keys lie in substantially the same actuation plane.

2. The combination keyboard claimed in claim 1 wherein said switch closing elements are metal domes.

3. The combination keyboard claimed in claim 1 wherein said switch closing elements are plastic bubble membrane domes.

4. The combination keyboard claimed in claim 1 wherein said switch closing elements are conductive elastomer domes.

5. The combination keyboard claimed in claim 1 wherein said mounting means comprises: studs mounted on and extending outwardly from said membrane keyboard and through said discrete keyboard; spacers mounted on said studs between said membrane keyboard and said discrete keyboard; and, nuts mounted on said studs on the side of said discrete keyboard remote from the side facing said spacers.

6. The combination keyboard claimed in claim 5 wherein said switch closing elements are metal domes.

7. The combination keyboard claimed in claim 5 wherein said switch closing elements are plastic bubble membrane domes.

8. The combination keyboard claimed in claim 5 wherein said switch closing elements are conductive elastomer domes.

* * * * *